US009366124B2

(12) United States Patent
Brannon et al.

(10) Patent No.: US 9,366,124 B2
(45) **Date of Patent: *Jun. 14, 2016**

(54) SYSTEM AND METHOD FOR RE-FRACTURING MULTIZONE HORIZONTAL WELLBORES

(71) Applicant: BAKER HUGHES INCORPORATED, Houston, TX (US)

(72) Inventors: Harold D. Brannon, Magnolia, TX (US); Jimie DeVon Lemons, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 140 days.

This patent is subject to a terminal disclaimer.

(21) Appl. No.: 14/091,677

(22) Filed: Nov. 27, 2013

(65) Prior Publication Data

US 2015/0144347 A1 May 28, 2015

(51) Int. Cl.
*E21B 43/26* (2006.01)
*E21B 43/14* (2006.01)

(52) U.S. Cl.
CPC ..... *E21B 43/261* (2013.01); *E21B 43/14* (2013.01); *E21B 43/26* (2013.01)

(58) Field of Classification Search
CPC ..... E21B 43/26; E21B 43/261; E21B 33/12
See application file for complete search history.

(56) References Cited

U.S. PATENT DOCUMENTS 4,951,751 A * 8/1990 Jennings, Jr. ..... C09K 8/60 166/270
5,273,115 A * 12/1993 Spafford ..... E21B 43/261 166/281
5,462,118 A * 10/1995 Jennings, Jr. ..... E21B 41/0078 166/222
6,446,727 B1 * 9/2002 Zemlak ..... E21B 17/20 166/177.5
7,062,420 B2 * 6/2006 Poe, Jr. ..... 703/10

(Continued)

OTHER PUBLICATIONS

International Search Report and Written Opinion issued in PCT Application No. PCT/US2014/065532 dated Mar. 13, 2015.

*Primary Examiner* — Zakiya W Bates
*Assistant Examiner* — Crystal J Miller
(74) *Attorney, Agent, or Firm* — Parsons Behle & Latimer

(57) ABSTRACT

A packer on a tubing string and diverting material pumped down the tubing string may be used to isolate a fracture cluster in a multizone horizontal wellbore that has been previously hydraulically fractured. Once hydraulically isolated, fluid may be pumped down the tubing string to re-fracture the previously fractured fracture cluster in an effort to increase hydrocarbon production from the horizontal wellbore. The tubing string may include a testing device used to determine whether a specific fracture cluster within the horizontal wellbore should be re-fractured. Diverting material may be pumped down the tubing string and positioned adjacent a fracture cluster to hydraulically isolate the fracture cluster during the re-fracturing process. The diverting material may be cleaned out of the horizontal wellbore after all desired fracture clusters along the horizontal wellbore have been individually re-fractured.

19 Claims, 11 Drawing Sheets

(56) References Cited

U.S. PATENT DOCUMENTS 7,096,954 B2 * 8/2006 Weng ..... E21B 43/26 166/177.5
7,225,869 B2 * 6/2007 Willett ..... E21B 43/114 166/280.1
7,278,486 B2 * 10/2007 Alba ..... E21B 33/128 166/297
7,380,600 B2 * 6/2008 Willberg ..... C09K 8/42 166/280.1
7,389,185 B2 * 6/2008 Craig ..... E21B 49/008 702/13
7,478,676 B2 * 1/2009 East, Jr. ..... E21B 33/1208 166/191
7,766,083 B2 * 8/2010 Willett ..... E21B 43/114 166/280.1
7,934,556 B2 * 5/2011 Clark ..... E21B 43/14 166/250.01
8,141,638 B2 * 3/2012 Tulissi ..... C09K 8/685 166/177.5
8,167,043 B2 * 5/2012 Willberg ..... C09K 8/42 166/280.1
8,210,257 B2 * 7/2012 Dusterhoft ..... E21B 43/26 166/250.1
8,220,543 B2 * 7/2012 Clark ..... E21B 43/14 166/250.01
8,646,529 B2 * 2/2014 Clark ..... E21B 43/14 166/281
8,726,991 B2 * 5/2014 Boney ..... C09K 8/68 166/281
8,794,316 B2 * 8/2014 Craig ..... E21B 43/26 166/250.01
8,857,513 B2 * 10/2014 O'Malley ..... E21B 43/261 166/281
8,887,803 B2 * 11/2014 East, Jr. ..... E21B 34/14 166/250.01
9,027,641 B2 * 5/2015 Alekseenko et al. ..... 166/250.1
2002/0092650 A1 * 7/2002 Tolman ..... E21B 17/203 166/298
2002/0096324 A1 * 7/2002 Poe, Jr. ..... E21B 43/00 166/250.15
2003/0121663 A1 * 7/2003 Weng ..... E21B 43/26 166/308.1
2005/0211439 A1 * 9/2005 Willett ..... E21B 43/114 166/308.1
2006/0113077 A1 * 6/2006 Willberg ..... C09K 8/42 166/280.1
2006/0196667 A1 * 9/2006 Alba ..... E21B 33/128 166/308.1
2007/0083331 A1 * 4/2007 Craig ..... E21B 49/008 702/13
2007/0284109 A1 * 12/2007 East ..... E21B 33/1208 166/305.1
2008/0000639 A1 * 1/2008 Clark ..... E21B 43/14 166/281
2008/0110622 A1 * 5/2008 Willett ..... E21B 43/114 166/280.2
2008/0200352 A1 8/2008 Willberg et al.
2008/0210424 A1 * 9/2008 Dusterhoft ..... C09K 8/685 166/292
2008/0289823 A1 * 11/2008 Willberg ..... C09K 8/42 166/280.2
2009/0250211 A1 * 10/2009 Craig ..... E21B 49/008 166/250.16
2010/0084134 A1 * 4/2010 Tulissi ..... C09K 8/685 166/281
2010/0212906 A1 * 8/2010 Fulton ..... C09K 8/68 166/308.5
2011/0067871 A1 * 3/2011 Burdette ..... E21B 43/119 166/298
2011/0186298 A1 * 8/2011 Clark ..... E21B 43/14 166/310
2011/0209868 A1 * 9/2011 Dusterhoft ..... E21B 43/26 166/250.1
2011/0220363 A1 9/2011 Gupta et al.
2011/0226479 A1 * 9/2011 Tippel et al. ..... 166/305.1
2012/0285690 A1 * 11/2012 Weaver ..... C09K 8/57 166/305.1
2013/0032349 A1 * 2/2013 Alekseenko et al. ..... 166/308.1
2013/0048282 A1 * 2/2013 Adams et al. ..... 166/279
2013/0105157 A1 * 5/2013 Barmatov et al. ..... 166/280.1
2013/0146291 A1 6/2013 O'malley
2013/0168082 A1 * 7/2013 Clark ..... E21B 43/14 166/250.01
2013/0186625 A1 * 7/2013 O'Malley ..... E21B 43/261 166/281
2013/0264054 A1 * 10/2013 East ..... E21B 34/14 166/270.1
2015/0027692 A1 * 1/2015 East ..... E21B 34/14 166/250.1
2015/0053397 A1 * 2/2015 Filyukov ..... E21B 43/116 166/191
2015/0075779 A1 * 3/2015 Walters ..... E21B 49/008 166/250.1

* cited by examiner

SYSTEM AND METHOD FOR RE-FRACTURING MULTIZONE HORIZONTAL WELLBORES

BACKGROUND

1. Field of the Disclosure

The embodiments described herein relate to a system and method for re-fracturing select locations, such as prior perforations, prior fractures, and/or prior fracture clusters, of the formation of a multizone horizontal wellbore. The formation may also re-fracture the formation through a sliding sleeve left open during a prior hydraulic fracturing process.

2. Description of the Related Art

Natural resources such as gas and oil may be recovered from subterranean formations using well-known techniques. For example, a horizontal wellbore may be drilled within the subterranean formation. After formation of the horizontal wellbore, a string of pipe, e.g., casing, may be run or cemented into the well bore. Hydrocarbons may then be produced from the horizontal wellbore.

In an attempt to increase the production of hydrocarbons from the wellbore, the casing may be perforated and fracturing fluid may be pumped into the wellbore to fracture the subterranean formation. The fracturing fluid is pumped into the well bore at a rate and a pressure sufficient to form fractures that extend into the subterranean formation, providing additional pathways through which fluids being produced can flow into the well bores. The fracturing fluid typically includes particulate matter known as a proppant, e.g., graded sand, bauxite, or resin coated sand, may be suspended in the fracturing fluid. The proppant becomes deposited into the fractures and thus holds the fractures open after the pressure exerted on the fracturing fluid has been released.

Another method to increase the production of hydrocarbons from a wellbore is to attempt to fracture the formation through ported collars or tubulars within the wellbore. Typically, these ported collars may be selectively closed by a sliding sleeve, which may be actuated to an open position by various means such as by the use of a shifting tool or by the application of a pressure differential. Once the port is opened, fracturing fluid may be pumped down the well and out the port in an attempt to fracture the formation to increase production of hydrocarbons.

A production zone within a wellbore may have been previously fractured, but the prior fracturing may not have adequately fractured the formation leading to inadequate production from the production zone. Even if the formation was adequately fractured, the production zone may no longer be producing at adequate levels. Over an extended period of time, the production from a previously fractured horizontal wellbore may decrease below a minimum threshold level. One technique in attempting to increase the hydrocarbon production from the wellbore is the addition of new fractures within the subterranean formation. One potential problem in introducing new fractures in the formation is that fracturing fluid pumped into the wellbore may enter prior fractures formed in the subterranean formation instead of creating new fractures. Expandable tubulars or cladding procedures have been used within a wellbore in an attempt to block the flow path of the fracturing fluid to the old fractures, instead promote the formation of new fracture clusters. The use of expandable tubulars or cladding may not adequately provide the desired results and further, may incur too much expense in the effort to increase products from the wellbore. A more efficient way to increase the production of a horizontal wellbore is needed.

SUMMARY

The present disclosure is directed to a method and system for re-fracturing select locations of a formation in a multizone horizontal wellbore that have been previously fractured or were attempted to be fractured that overcomes some of the problems and disadvantages discussed above.

One embodiment is a method for re-fracturing a location of a formation of a multizone horizontal wellbore comprising hydraulically isolation a first location from a portion of the multizone wellbore uphole from the first location, the first location having been previously hydraulically fractured at least once and hydraulically re-fracturing the first location. The method comprises providing a first diverting material proximate to the first location after the first location has been hydraulically re-fractured, wherein the first diverting material hydraulically isolates the re-fractured first location from the multizone horizontal wellbore uphole of the first location. The method comprises hydraulically isolating a second location from a portion of the multizone horizontal wellbore uphole of the second location, the second location having been previously hydraulically fractured at least once and hydraulically re-fracturing the second location. The method comprises providing a second diverting material proximate to the second location after the second location has been re-fractured, wherein the second diverting material hydraulically isolates the re-fractured second location from a portion of the multizone horizontal wellbore uphole of the second location.

The first location may be a fracture cluster farther downhole of the multizone horizontal wellbore and wherein hydraulically isolating the first location may include creating a seal with a packing element connected to a coiled tubing string to seal an annulus between the coiled tubing string and a casing of the multizone horizontal wellbore uphole of the first location. The method may include cleaning out at least a portion of the multizone horizontal wellbore prior to hydraulically isolating the first location. The method may include cleaning out at least a portion of the multizone horizontal wellbore after re-fracturing the first and second locations to remove the first and second diverting materials from the multizone horizontal wellbore. The method may include producing hydrocarbons from the re-fractured first and second locations of the multizone horizontal wellbore. The first and second diverting material may comprises one or more of a thermoset plastic, a thermoset polymer, a sand plug, disintegrating frac balls, a gel, a cross-linked gel, frac balls, dissolving material, fiber laden diversion fluid, particulates, or a bridge of degradable particles. The method may include determining whether to hydraulically re-fracture the first location prior to hydraulically re-fracturing the first location and determining whether to hydraulically re-fracture the second location prior to hydraulically re-fracturing the second location. The method may include logging the first and second locations with a logging tool. There may be at least one fracture cluster positioned between the first location and the second location. Hydraulically isolation the second location may include providing a third diverting material between the first and second locations and creating a seal with a packing element connected to a coiled tubing string to seal an annulus between the coiled tubing string and a casing of the multizone horizontal wellbore uphole from the second location, wherein the third diverting material is provided prior to creating the seal uphole from the second location.

One embodiment is a system for re-fracturing a plurality of locations within a multizone horizontal wellbore comprising a first tubing string positioned within a multizone horizontal wellbore, the first tubing string extending from a surface location to a first location in the multizone horizontal wellbore. The first location being a lowermost previously fractured location along the multizone horizontal wellbore. The system comprises a packing element connected proximate to an end of the first tubing string, the packing element adapted to repeatedly seal an annulus between the first tubing string and a casing of the multizone horizontal wellbore, the end of the first tubing string being adapted to permit the hydraulic re-fracturing of selected locations within the multizone horizontal wellbore. The system comprises a plurality of diverting material, each of the plurality of diverting material positioned proximate to a previously fractured location to selectively hydraulically isolate the previously fractured location.

The first tubing string may be a coiled tubing string. The first tubing string may be comprised of a section of rigid tubing connected to a lower end of a coiled tubing string. The system may include a testing device connected to a second tubing string, the testing device adapted to determine whether a previously fractured location should be re-fractured, wherein the second tubing string is positioned within the multizone horizontal wellbore prior to the first tubing string being positioned within the multizone horizontal wellbore. The testing device may be a logging device.

One method is a method for selectively re-fracturing one or more previously fractured locations within a wellbore comprising positioning a packing element uphole of a first previously fractured location, the packing element being connected to a tubing string and actuating the packing element to seal an annulus between the tubing string and a casing uphole of the first previously fractured location. The method comprises pumping fluid down the tubing string to re-fracture the first previously fractured location and providing a first diverting material proximate the re-fractured first previously fractured location. The method comprises unsetting the packing element and positioning the packing element uphole of a second previously fractured location. The method comprises actuating the packing element to seal the annulus between the tubing string and the casing uphole of the second previously fractured location and pumping fluid down the tubing string to re-fracture the second previously fractured location. The method comprises providing a second diverting material proximate the re-fractured second previously fractured location.

The method may include positioning a testing device proximate to the first previously fractured location and determining that the first previously fractured location should be re-fractured prior to re-fracturing the first previously fractured location and positioning the testing device proximate to the second previously fractured location and determining that the second previously fractured location should be re-fractured prior to re-fracturing the second previously fractured location. The method may include removing the first and second diverting materials and producing hydrocarbons from the re-fractured first and second previously fractured locations. The method may include determining a third previously fractured location should not be re-fractured prior to positioning the packing element uphole of the second previously fractured location, wherein the third previously fractured location is positioned between the first previously fractured location and the second previously fractured location. The method may include providing a third diverting material proximate the third previously fractured location prior to positioning the packing element uphole of the second previously fractured location.

Figure 1:
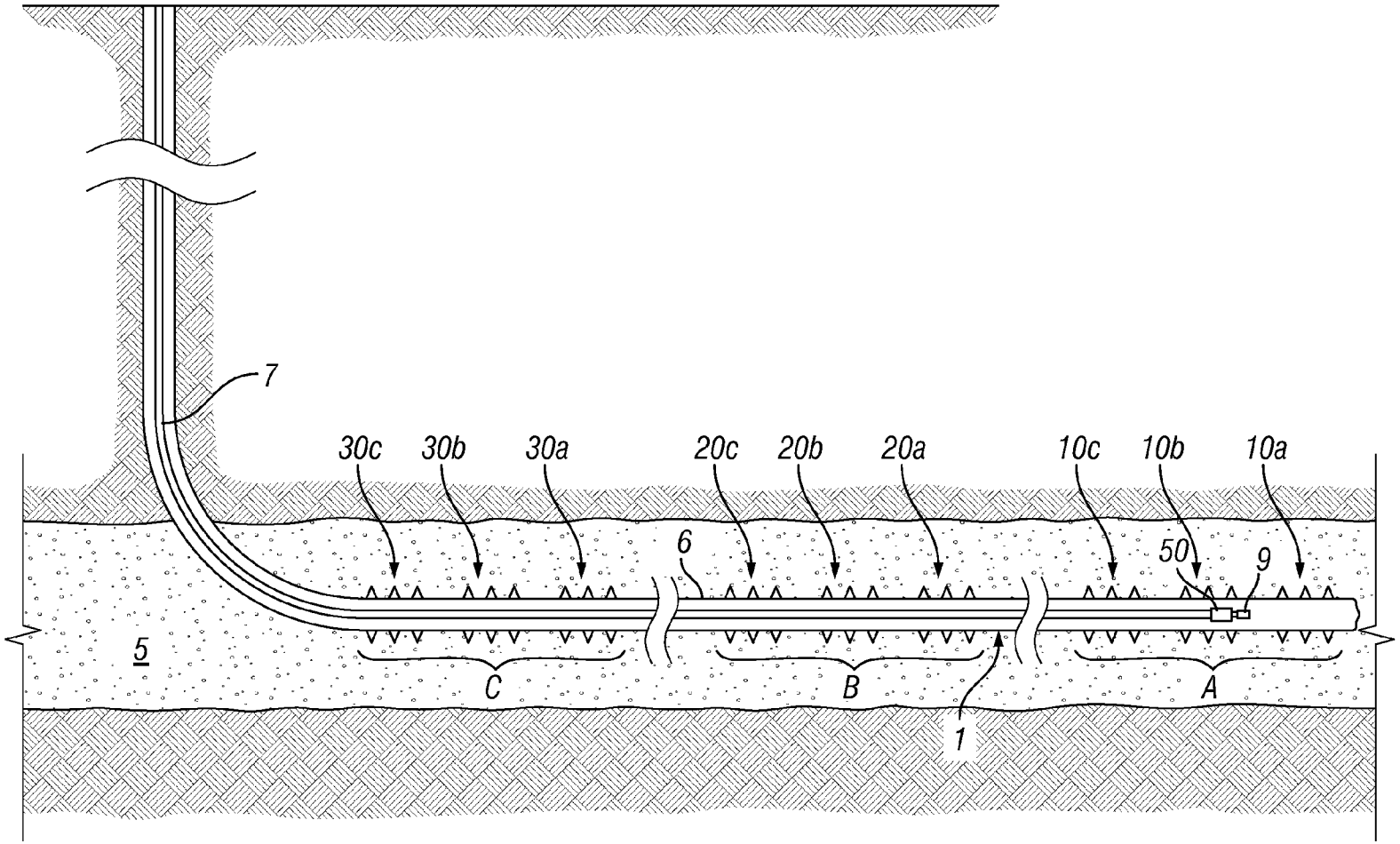
FIG. 1 shows a tubing string positioned in a portion of a multizone horizontal wellbore that includes a plurality of locations that previously have been hydraulically fractured.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

FIG. 1 shows a schematic of a multizone horizontal wellbore 1 within a well formation 5. The horizontal wellbore 1 includes a plurality of zones A, B, and C that each may contain a plurality of locations 10*a*, 10*b*, 10*c*, 20*a*, 20*b*, 20*c*, 30*a*, 30*b*, and 30*c* that have been previously fractured. The locations 10*a*, 10*b*, 10*c*, 20*a*, 20*b*, 20*c*, 30*a*, 30*b*, and 30*c* may be prior fractures, fracture clusters, or perforations within a casing. As discussed herein, each location may include one or more fracture clusters that have been previously fractured or were attempted to be previously fractured. Although the figures only show a multizone horizontal wellbore with cemented casing, the location may also be a fracture port in a ported completion that has been left open after a prior fracturing operation in an attempt to fracture the formation behind the fracture port. For example, the system and method disclosed herein may be used to re-fracture the formation 5 through the ported completion disclosed in U.S. patent application Ser. No. 12/842,099 entitled Bottom Hole Assembly With Ported Completion and Methods of Fracturing There-with, filed on Jul. 23, 2010 by John Edward Ravensbergen and Lyle E. Laun, which is incorporated by reference herein in its entirety.

For illustrative purposes only, FIG. 1 shows three zones or segments of the multizone horizontal wellbore 1. Likewise, FIG. 1 shows three previously fractured locations per zone or segment, for illustrative purposes only. A multizone horizontal wellbore 1 may include a various number of zones or segments such as A, B, and C that have been previously fractured, as would be appreciated by one of ordinary skill in the art having the benefit of this disclosure. Likewise, the number of previously fractured locations within each zone or segment may vary. As discussed above, the previously hydraulically fractured locations may comprise a perforation through casing that was attempted to be fractured, a fracture or fracture cluster in the formation, or a fracture port in a completion. A previously fractured location includes any location within a wellbore that has been previously subjected to a fracturing treatment, in an attempt to fracture the formation at that location, whether or not the formation actually fractured. Hereinafter, the previously fractured locations will be referred to as a fracture cluster, but such locations should not be limited to those previously fractured locations that resulted in a fracture cluster and may include any of the above noted, or other fracture locations.

A production zone may have as few as a single fracture cluster or may include more than ten (10) fracture clusters. The multiple zones of a multizone horizontal wellbore 1 may include a plurality of fracture clusters 10, 20, and 30 that extend into the formation 5 that surrounds the casing 6 of the multizone horizontal wellbore 1. As discussed above, the formation 5 is fractured by a plurality of fracture clusters 10, 20, and 30 to increase the production of hydrocarbons from the wellbore. When the rate of production from the horizontal wellbore decreases below a minimum threshold value it may be necessary to re-fracture selected fracture clusters 10, 20, and 30 within the wellbore 1, as discussed below.

Figure 2:
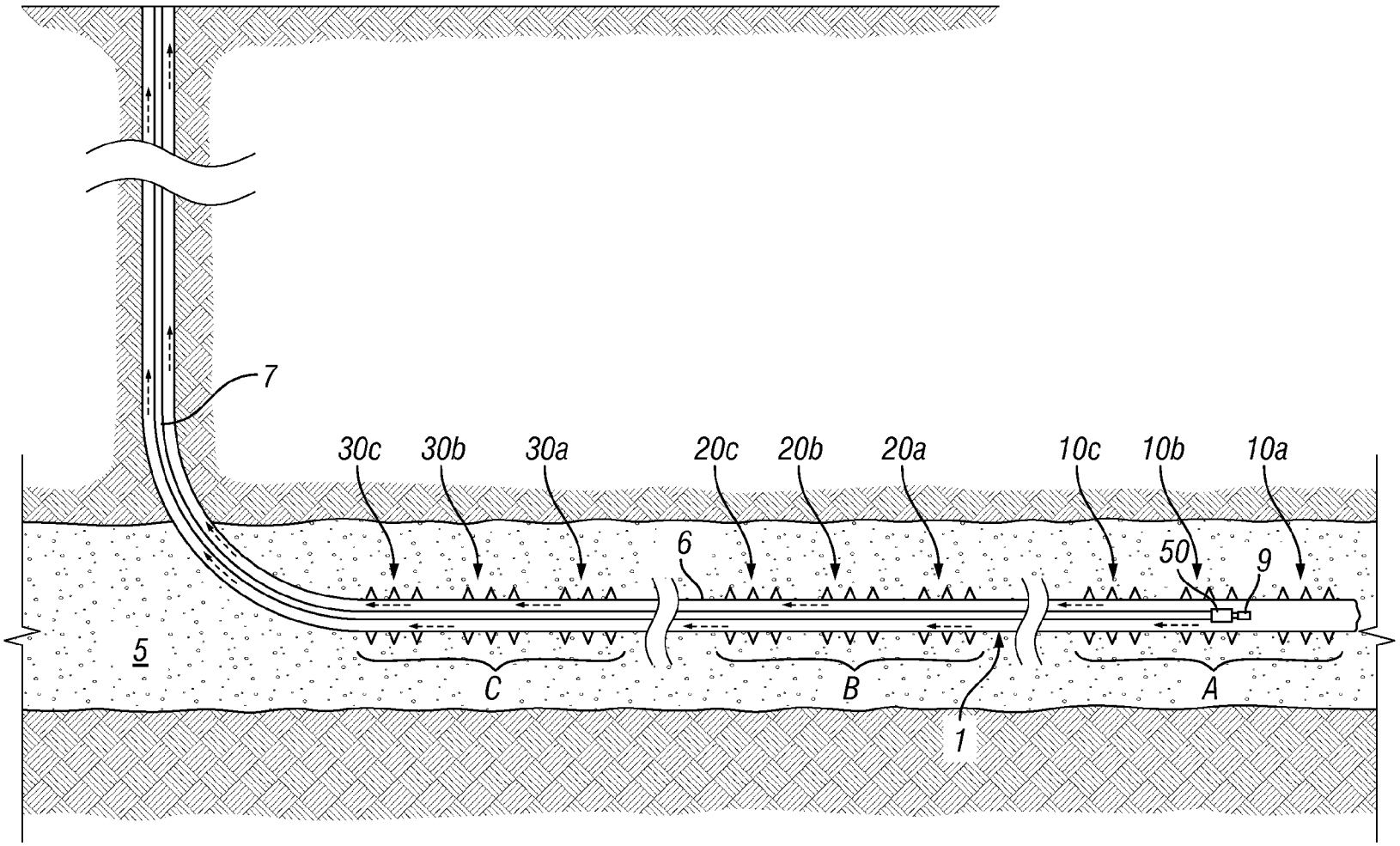
FIG. 2 shows a tubing string providing a cleanout procedure on a portion of a multizone horizontal wellbore that includes a plurality of locations that previously have been hydraulically fractured.

A tubing string 7 may be positioned within the casing 6 of the horizontal wellbore 1. Fluid may be pumped down the tubing string 7 and out the end 9 of the tubing string and reverse circulated up the annulus to clean out the horizontal wellbore 1 prior to the re-fracturing process as shown in FIG. 2. The tubing string 7 may include a testing device 50 that may be used to determine whether a fracture cluster, such as 10*a*, 10*b*, 10*c*, 20*a*, 20*b*, 20*c*, 30*a*, 30*b*, or 30*c*, should be re-fractured. For example, the testing may be a logging device. The testing device 50 may indicate that a fracture cluster should be skipped in the re-fracturing process. The testing device 50 may determine various parameters that may be helpful to determine whether a location should be re-fractured such as casing integrity, wellbore characterization, formation evaluation, and/or production analysis.

After the horizontal wellbore 1 has been cleaned out, a tubing string 7 may be positioned within the casing 6 of the horizontal wellbore 1 having a packer or sealing element 8, hereinafter referred to as a packer. The packer 8 may be actuated to create a seal in the annulus between the tubing string 7 and the casing. The tubing string 7 may be comprised of various tubulars that permit locating and operating a packer or sealing element, as discussed below, within the horizontal wellbore 1 and also permit the pumping of fluid down the tubing string 7 to a desired location along the horizontal wellbore 1. For example, the tubing string 7 may be coiled tubing that extends from the surface to the location of the fracture cluster 10*a* positioned farthest downhole of the horizontal wellbore 1. Another example is a tubing string 7 comprised of a rigid tubular section 70 connected to coiled tubing 75, as shown schematically in FIG. 10. It may be preferred use only a relative short length of rigid tubing 70 in comparison to the overall length of the tubing string 7 due to the greater weight of rigid tubing 70 in comparison to coiled tubing 75.

Figure 3:
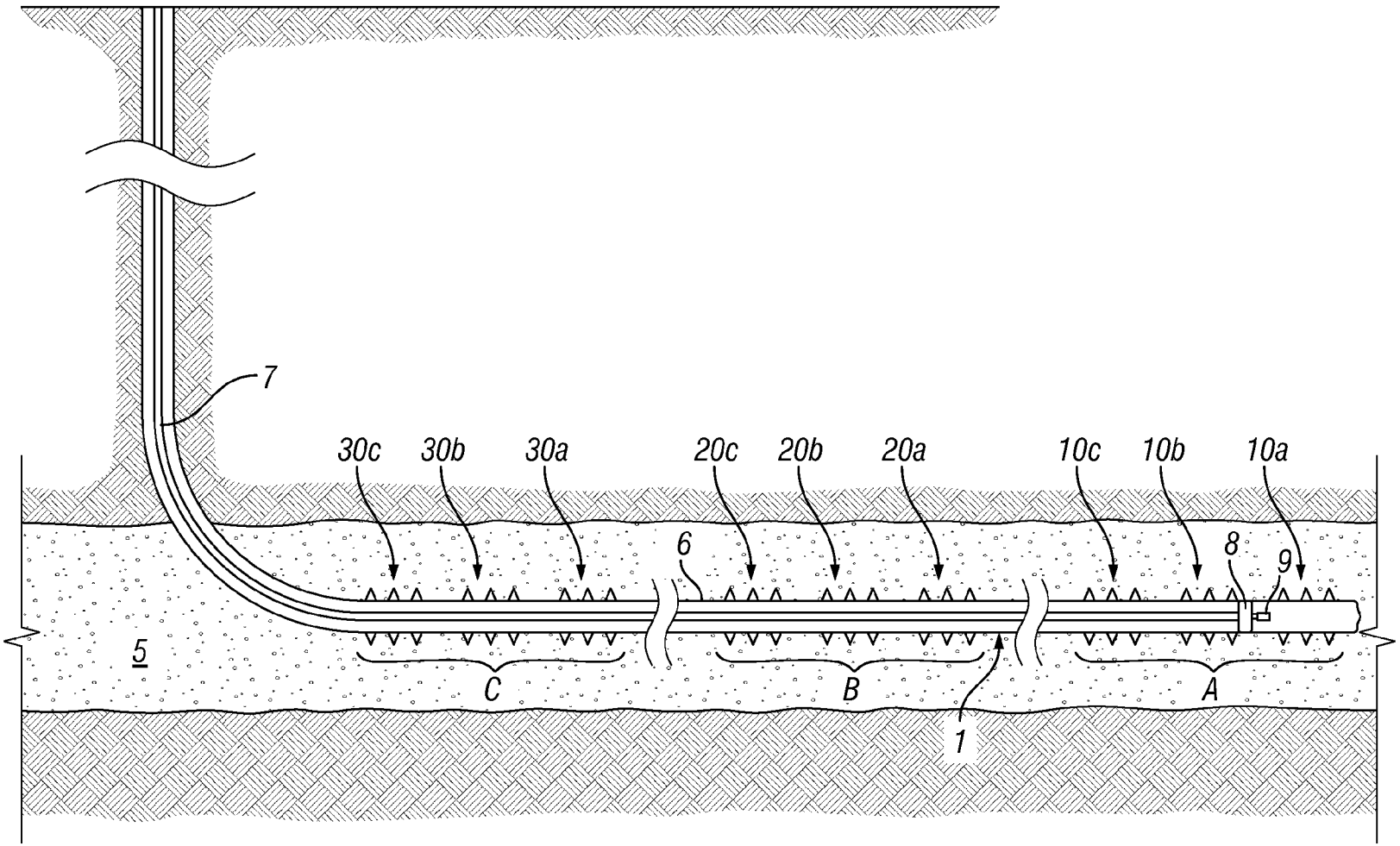
FIG. 3 shows an actuated packer on a tubing string creating a seal above the lowermost location of a multizone horizontal wellbore that has previously been hydraulically fractured.

The packer 8 may be positioned uphole of the lowermost fracture cluster 10*a* and actuated to create a seal between the tubing string 7 and the casing 6 of the horizontal wellbore 6. FIG. 3 shows the packer 8 actuated to hydraulically isolate the lowermost fracture cluster 10*a* from the portion of the horizontal wellbore 1 located above the actuated packer 8. Various packers and/or sealing elements may be used to in connection with the tubing string 7 to hydraulically isolate the fracture cluster 10*a* as would be appreciated by one of ordinary skill in the art having the benefit of this disclosure.

The packer 8 includes a sealing element may be repeatedly actuated and/or energized to create a seal between the tubing string 7 and the wellbore casing 6. Debris within the annulus may potentially interfere with the repeated actuation of the packer 8. In an effort to minimize interference from debris within the wellbore 1, the packer 8 may include a debris exclusion device, such as one or more cups, positioned downhole from the packing element, which may help to prevent debris and/or material within the wellbore from interfering with the creation of a seal by the sealing element of the packer 8. One example of such a packing element is discussed in U.S. Pat. No. 6,315,041 to Stephen L. Carlisle and Douglas J. Lehr entitled Multi-zone Isolation Tool and Method of Stimulating and Testing a Subterranean Well, which is incorporated by reference herein in its entirety.

Figure 4:
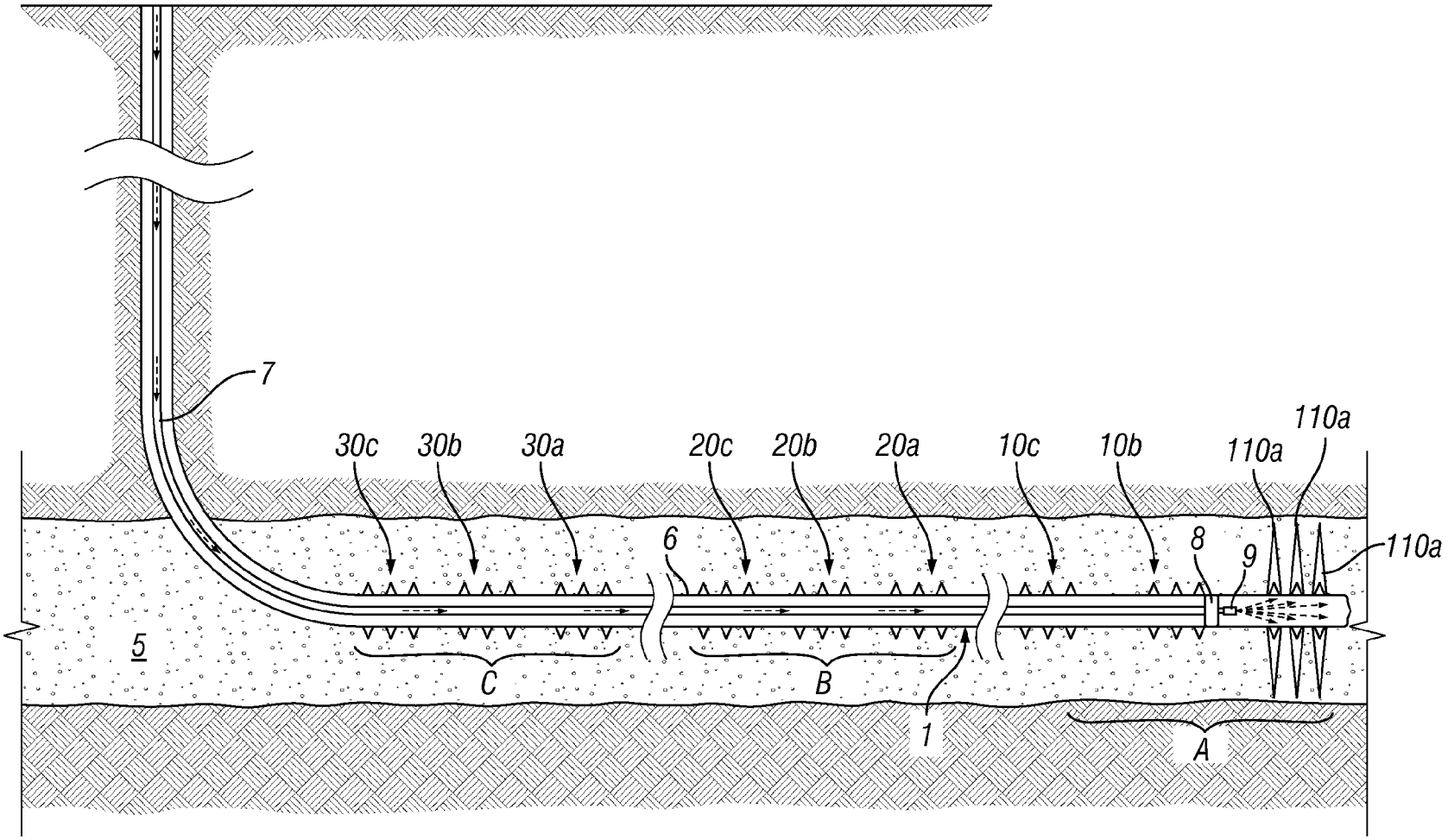
FIG. 4 shows re-fracturing the lowermost fracture location of a multizone horizontal wellbore.
Figure 5:
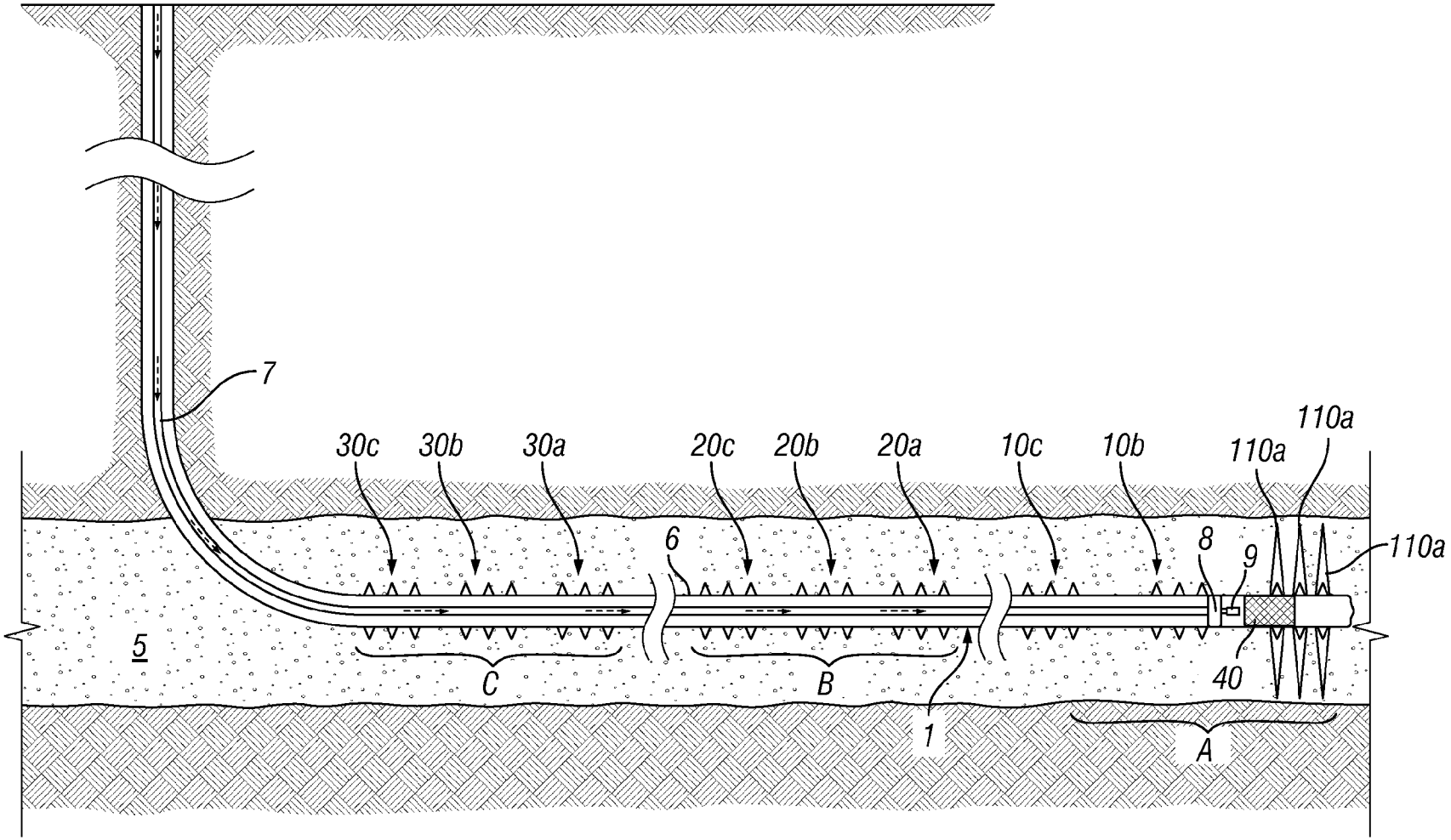
FIG. 5 shows the placement of a diverting material to hydraulically isolate the lowermost location after it has been re-fractured.

FIG. 4 shows that fluid is pumped down the tubing string 7 and out the end 9 of the tubing string 7 to hydraulically re-fracture cluster 110*a*, which was previously fractured fracture cluster 10*a* (shown in FIG. 1-3). After re-fracturing cluster 110*a*, a diverting material 40 may be placed within the horizontal wellbore 1 proximate to the re-fractured cluster 110*a* as shown in FIG. 5. The diverting material 40 hydraulically isolates the re-fractured cluster 110*a* from subsequent re-fracturing procedures within the horizontal wellbore 1. The diverting material 40 may be various materials that may be positioned within the wellbore 1 using the tubing string 7 that hydraulically isolates a fracture cluster from the portion of the wellbore 1 uphole from the diverting material 40. The diverting material 40 may be, but is not limited to, thermoset plastics, thermoset polymers, sand plugs, disintegrating frac balls such as this offered for sale by Baker Hughes under the trademark IN-TALLIC™, gels, cross-linked gels, frac balls, dissolving material, fiber laden diversion fluid, particulates, and/or a bridge of degradable particles as would be recognized by one of ordinary skill in the art having the benefit of this disclosure. The diverting material 40 is pumped down the tubing string 7 and positioned proximate to the re-fractured cluster 110*a* to hydraulically isolate the re-fractured cluster 110*a* during the re-fracturing process of an additional fracture cluster within the horizontal wellbore 1.

After the placement of diverting material 40 to isolate a re-fractured cluster 110*a* the tubing string 7 may be moved uphole to position the packer 8 above the next fracture cluster 10*b* that is to be re-fractured. As discussed below, the adjacent fracture cluster may not be the next fracture cluster to be re-fractured. Instead, a fracture cluster or multiple fracture clusters may be passed over during the re-fracturing process. Diverting material may be pumped down the tubing string 7 to isolate a passed over fracture cluster during the re-fracturing of the next fracture cluster.

Figure 6:
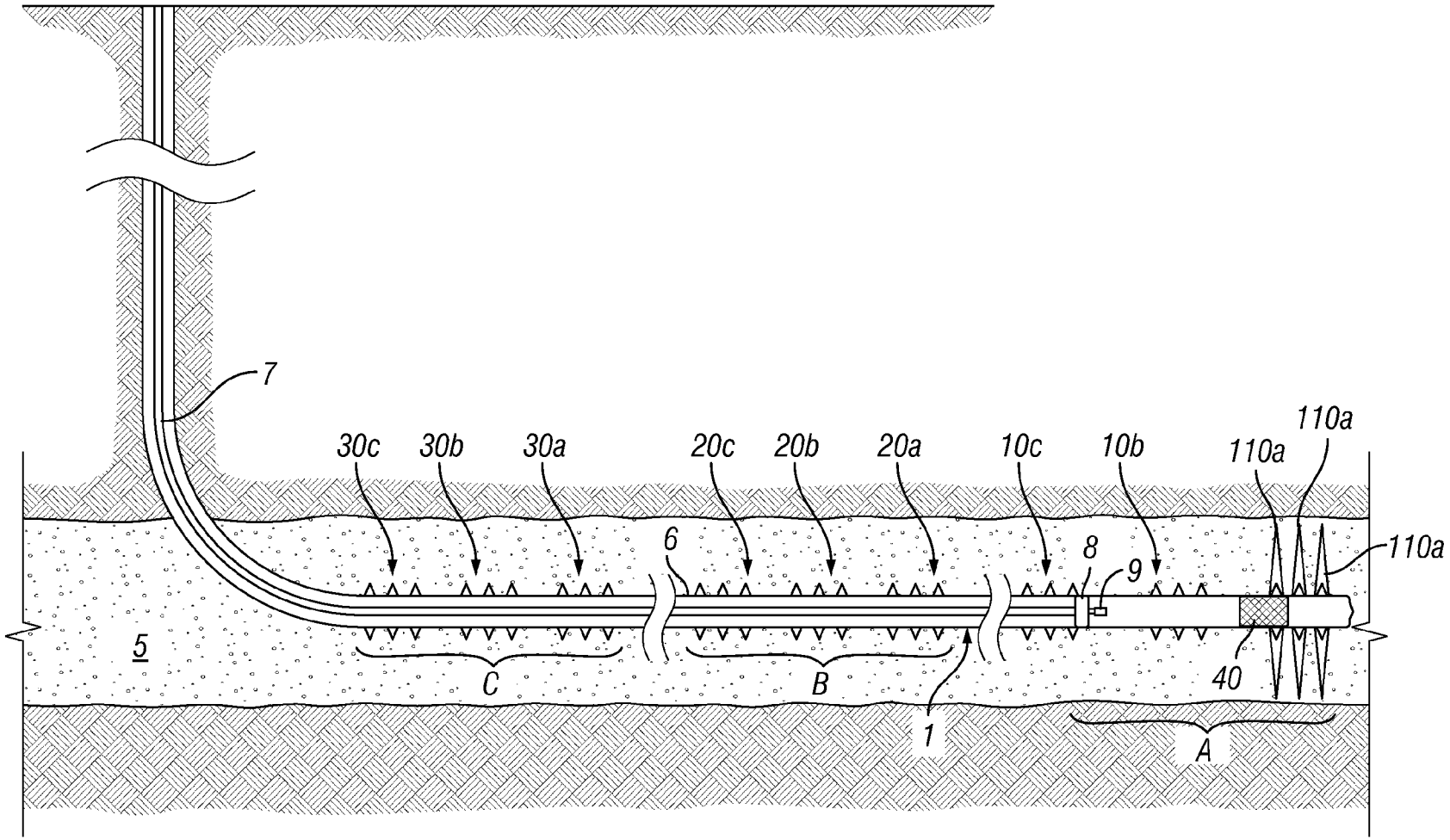
FIG. 6 shows an actuated packer on a tubing string creating a seal above a location that has previously been hydraulically fractured.
Figure 7:
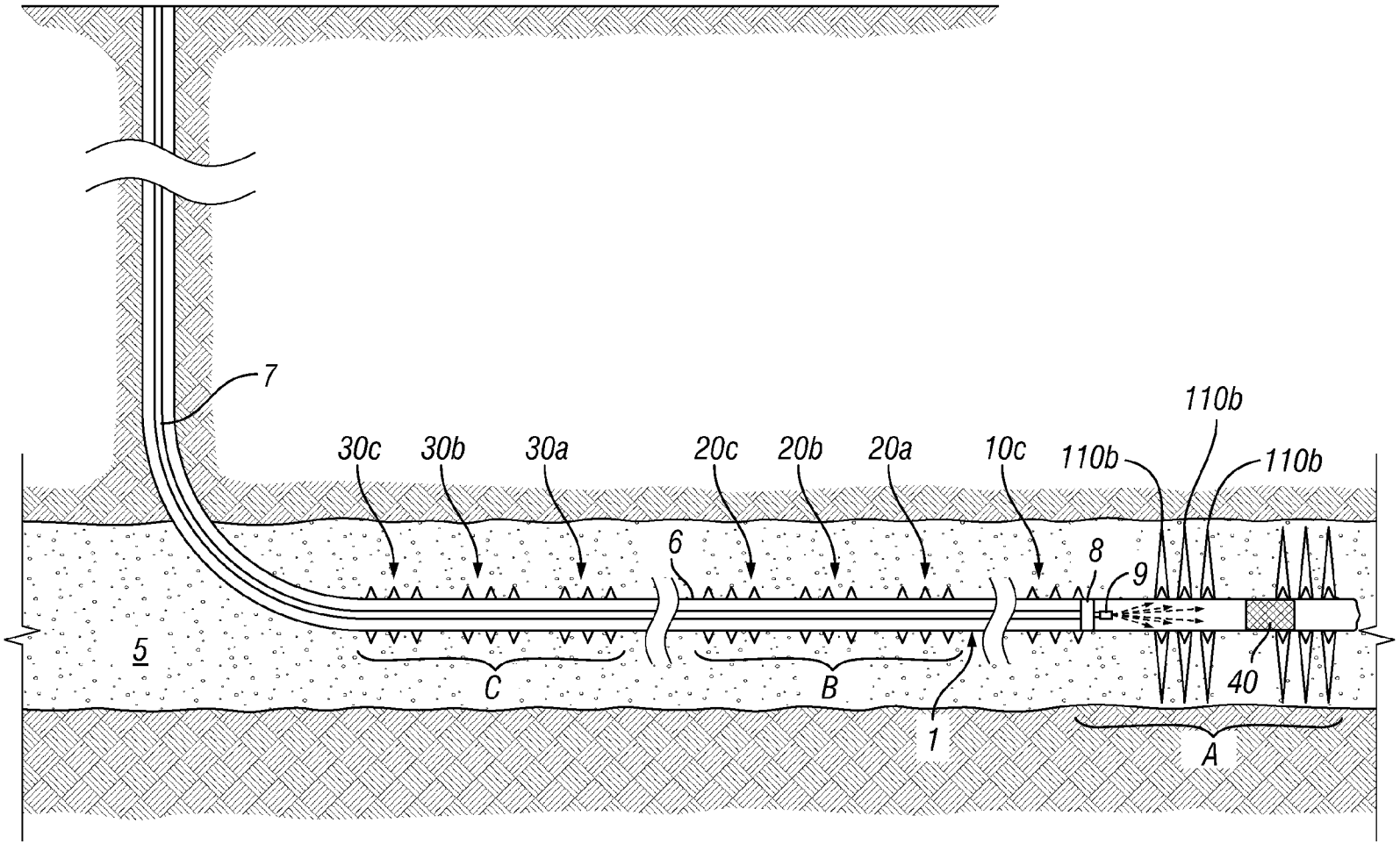
FIG. 7 shows re-fracturing a location of a multizone horizontal wellbore.
Figure 8:
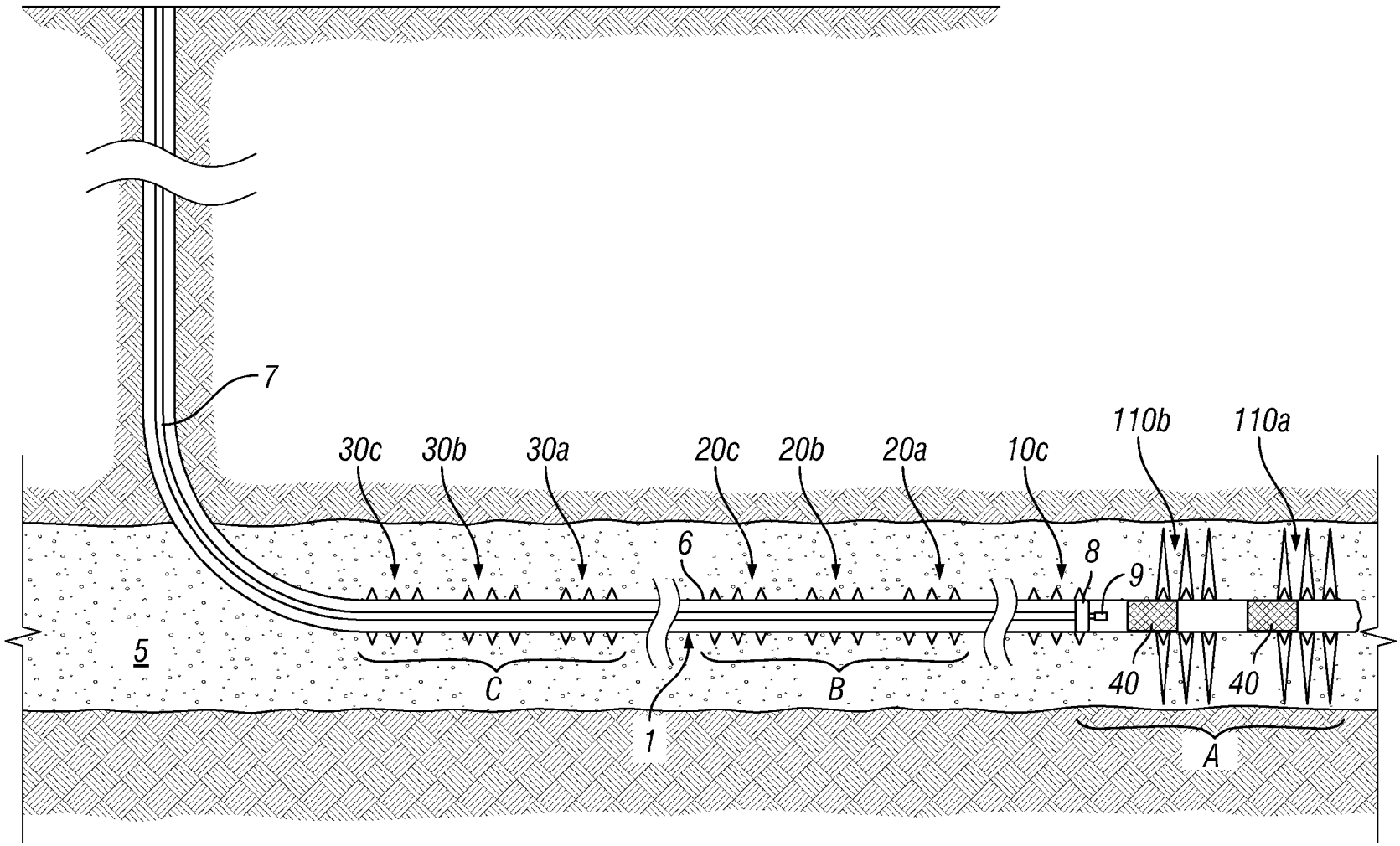
FIG. 8 shows the placement of a diverting material to hydraulically isolate a location that has been re-fractured as shown in FIG. 7.

FIG. 6 shows the packer 8 actuated to hydraulically isolate the fracture cluster 10*b* from the uphole portion of the horizontal wellbore 1. The diverting material 40 positioned adjacent the lower re-fractured cluster 110*a* in combination with the actuated packer 8 hydraulically isolates fracture cluster 10*b* from the rest of the horizontal wellbore 1. Once the fracture cluster 10*b* is isolated, fluid may be pumped down the tubing string 7 to re-fracture the cluster 110*b* as shown in FIG. 7. Diverting material 40 may be positioned adjacent the re-fractured cluster 110*b* after the re-fracturing process has been completed to hydraulically isolate the re-fracture cluster 110*b* from the uphole portion of the horizontal wellbore 1, as shown in FIG. 8. Hydraulically isolating the re-fractured cluster 110*b* permits the re-fracturing of another fracture cluster uphole from the re-fractured cluster 110*b*. This process of using a packer and diverting material may be repeated to re-fracture all desired fracture clusters, as would be recognized by one of ordinary skill in the art having the benefit of this disclosure.

Figure 9:
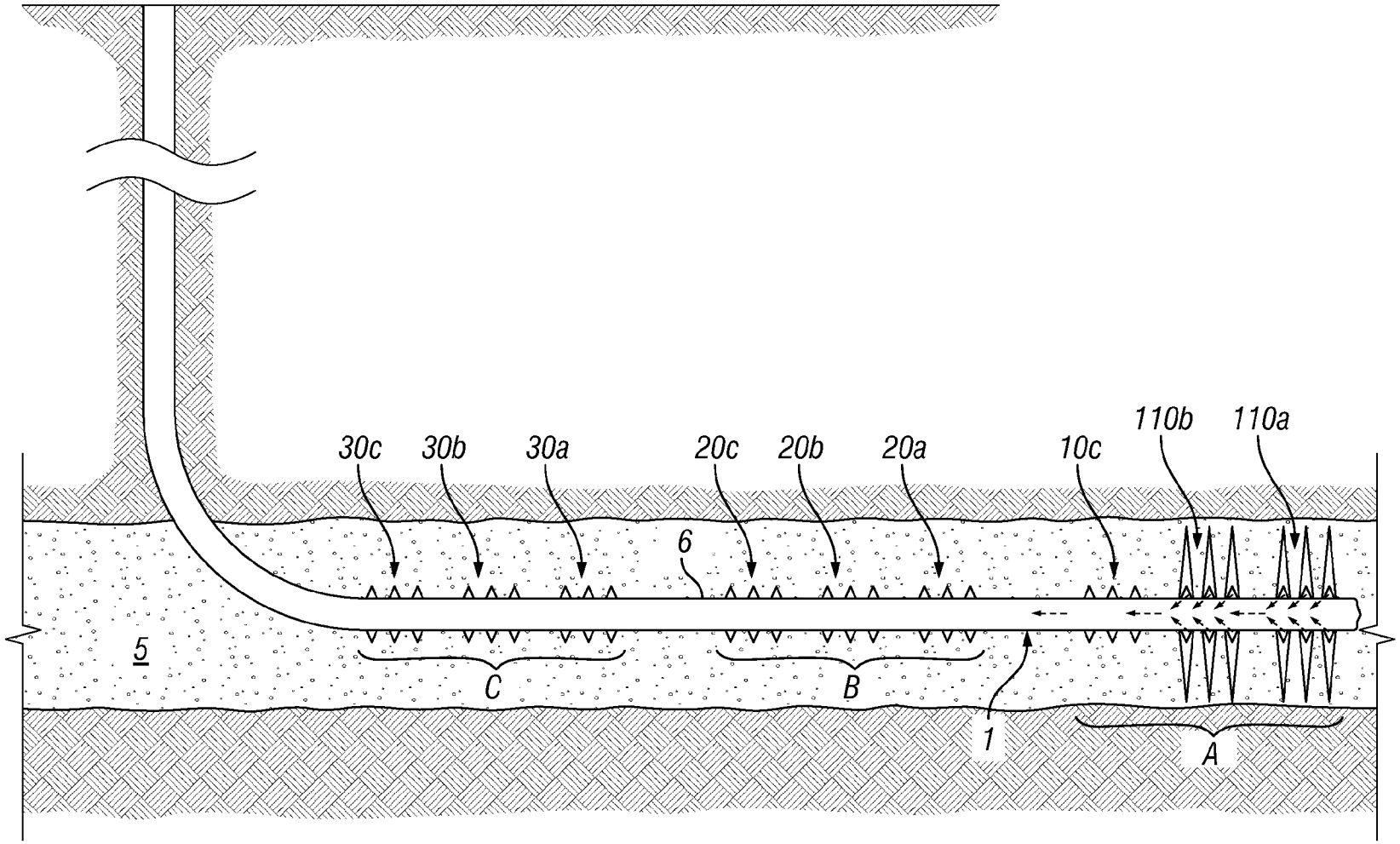
FIG. 9 shows a portion of a multizone horizontal wellbore that has been re-fractured with the tubing string removed, the diverting material has been removed from the multizone horizontal wellbore permitting the production of hydrocarbons from the re-fractured locations within the horizontal wellbore.

The diverting material 40 placed within the horizontal wellbore 1 to hydraulically isolate sections of the horizontal wellbore needs to be removed once it is desired to produce from the hydraulically isolated clusters and/or once all of the desired fracture clusters have been re-fractured. FIG. 9 shows a horizontal wellbore 1 from which all of the diverting material 40 adjacent re-fractured clusters 110*a* and 110*b* has been removed permitting production of hydrocarbons from re-fractured clusters 110*a* and 110*b*. The diverting material 40 may be removed by various means as would be appreciated by one of ordinary skill in the art having the benefit of this disclosure. For example, the diverting material may be removed by performing a clean-out procedure in the horizontal wellbore 1. Alternatively, the diverting material may be adapted to dissolve over a predetermined amount of time or dissolve upon the injection of a particular chemical into the horizontal wellbore.

Figure 10:
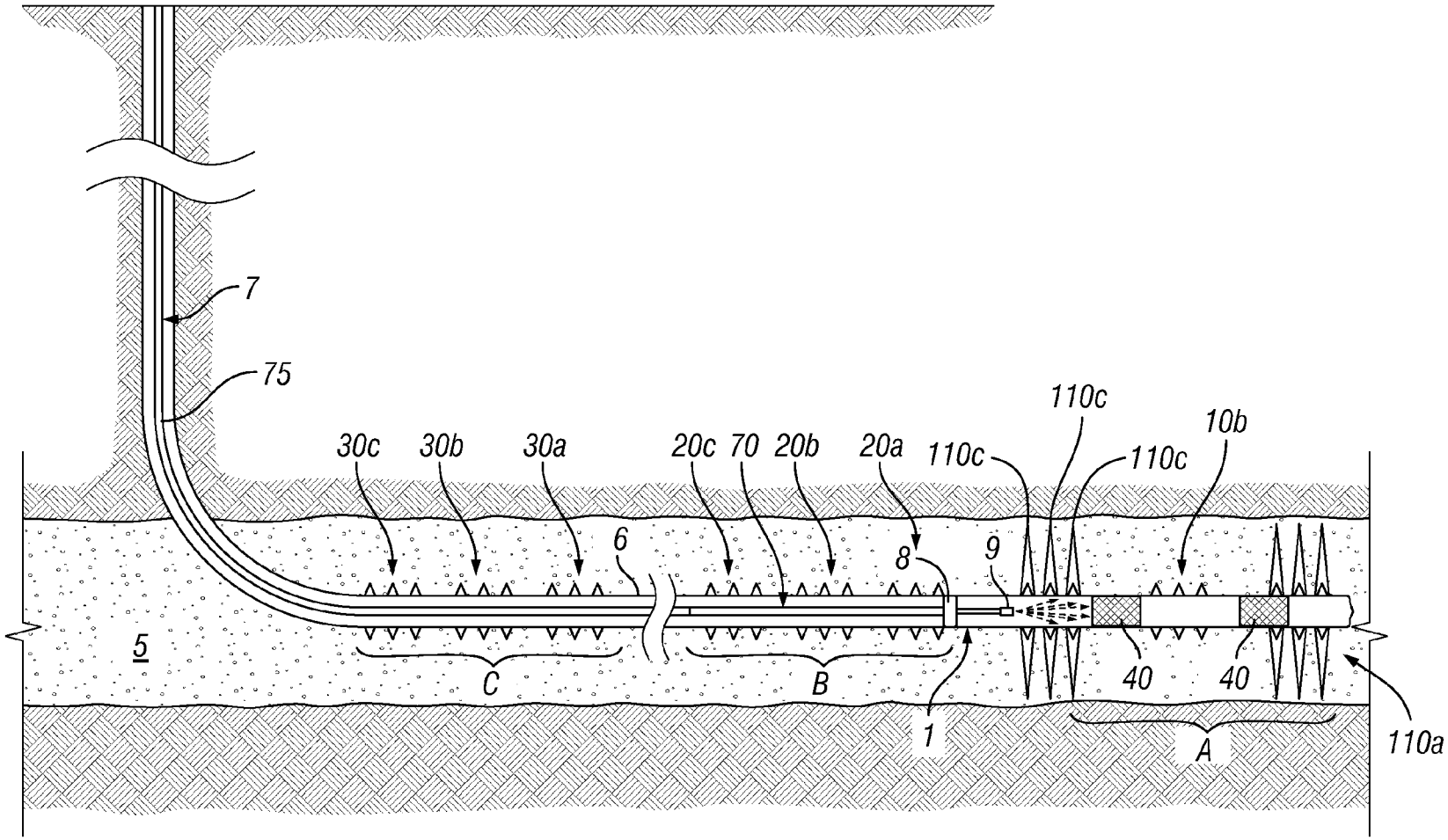
FIG. 10 shows a tubing string comprised of coiled tubing and rigid tubing positioned within a portion of a multizone horizontal wellbore with diverting material hydraulically isolating a location that is not to be re-fractured.

FIG. 10 schematically shows a tubing string 7 that is comprised of a coiled tubing 75 connected to a rigid tubular section 70. Due to the length of the horizontal wellbore, it may not be practical to for the entire string 7 to be comprised of rigid tubulars 70, which is heavier than coiled tubing 75. Instead, a short section, in comparison to the length of the horizontal wellbore 1, of rigid tubing 70 may be connected to another type of tubing string, such as coiled tubing 75. As discussed above, a tubing string 7 may include a testing device 50 may have already been used to determine whether a fracture cluster, such as 10*a*, 10*b*, 10*c*, 20*a*, 20*b*, 20*c*, 30*a*, 30*b*, or 30*c*, should be re-fractured. For example, the testing may be a logging device. The testing device 50 may indicate that a fracture cluster should be skipped in the re-fracturing process. For example, FIG. 10 shows that fracture cluster 10*b* was not re-fractured, but instead fracture cluster 10*c* was re-fractured as re-fractured cluster 110*c*. Diverting material 40 is positioned proximate to fracture cluster 10*b* to isolate fracture cluster 10*b* during the re-fracturing of fracture cluster 110*c*. Prior to pumping fluid down the tubing string 7, the packer 8 is energized above fracture cluster 10*c*. The actuated packer 8 in combination with the diverting material 40 adjacent to fracture cluster 10*b* isolates fracture cluster 10*c* during the re-fracturing process so that the fluid re-fractures cluster 110*c* and is not leaked off into fracture cluster 10*b*. Diverting material 40 may be used to isolation multiple fracture clusters that have been determined non-beneficial to re-fracture as would be appreciated by one of ordinary skill in the art having the benefit of this disclosure.

Figure 11:
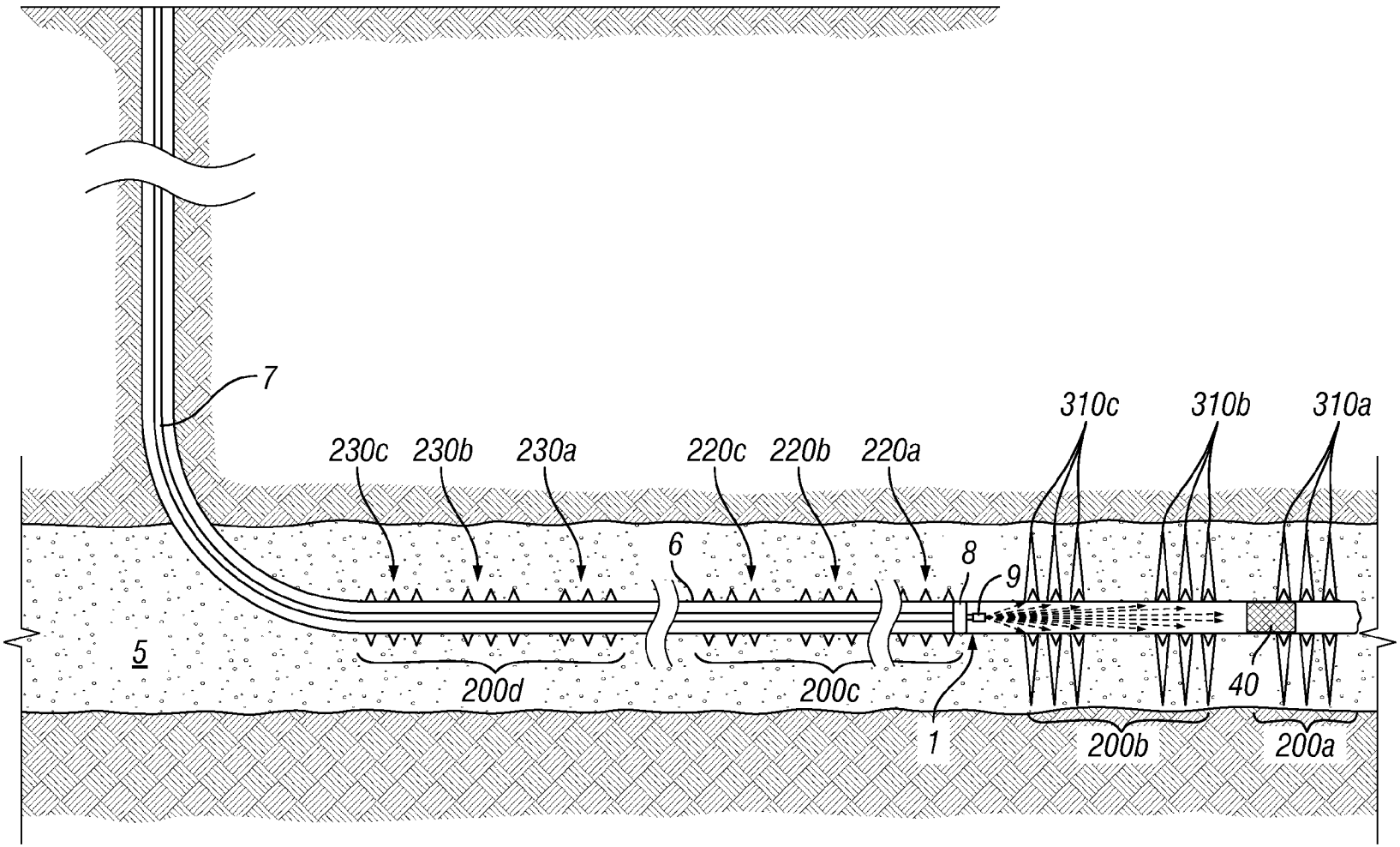
FIG. 11 shows re-fracturing a location of a multizone horizontal wellbore.

FIG. 11 shows the re-fracturing of a wellbore location 200*b*, which includes two fracture clusters 310*b* and 310*c* that have been previously fractured. Prior to re-fracturing location 200*b*, location 200*a*, which includes fracture cluster 310*a*, has been re-fractured. Diverting material 40 has been placed within the wellbore 1 to isolate location 200*a* during the re-fracturing of location 200*b*. After re-fracturing location 200*b*, diverting material may be positioned above location 200*b* and the packer 8 may be located above location 200*c* to permit the re-fracturing of location 200*c*. Location 200*c* may include a plurality of fracture clusters such as 220*a*, 220*b*, and 220*c*, as shown in FIG. 11. After re-fracturing location 200*c*, the location 200*c* may be hydraulically isolated and the packer 8 may be positioned above the next location 200*d* that is to be re-fractured. The next location 200*d* may include a single fracture cluster or a plurality of fracture clusters 230*a*, 230*b*, and 230*c*, as shown in FIG. 11. After re-fracturing a location, such as location 200*b*, a location, such as location 200*c*, may be isolated from being re-fractured if it is determined that the location should be not be re-fractured as discussed above.

Although this invention has been described in terms of certain preferred embodiments, other embodiments that are apparent to those of ordinary skill in the art, including embodiments that do not provide all of the features and advantages set forth herein, are also within the scope of this invention. Accordingly, the scope of the present invention is defined only by reference to the appended claims and equivalents thereof.

TABLE OF REFERENCE NUMERALS FOR FIGS. 1-10

A - section of horizontal wellbore containing multiple fracture clusters
B - section of horizontal wellbore containing multiple fracture clusters
C - section of horizontal wellbore containing multiple fracture clusters
1 - multizone horizontal wellbore
5 - formation
6 - casing of horizontal wellbore
7 - tubing string
8 - packing element
9 - end of tubing string
10a - previously fractured location in section A
10b - previously fractured location in section A
10c - previously fractured location in section A
20a - previously fractured location in section B
20b - previously fractured location in section B
20c - previously fractured location B
30a - previously fractured location C
30b - previously fractured location C
30c - previously fractured location C
40 - diverting material
50 - downhole testing device
70 - rigid pipe string
75 - coiled tubing
110a - re-fractured location in section A
110b - re-fractured location in section A
110c - re-fractured location in section A

What is claimed is:

1. A method for re-fracturing a location of a formation of a multizone horizontal wellbore, the method comprising:

positioning a coiled tubing string within a casing of a multizone horizontal wellbore;

hydraulically isolating a first location from a portion of the multizone horizontal wellbore uphole from the first location, the first location having been previously hydraulically fractured at least once, wherein hydraulically isolating the first location comprises creating a seal with a packing element connected to the coiled tubing string to seal an annulus between the coiled tubing string and the casing of the multizone horizontal wellbore uphole of the first location;

hydraulically re-fracturing the first location by pumping fluid down the coiled tubing string while the packing element seals the annulus;

providing a first diverting material proximate to the first location after the first location has been hydraulically re-fractured while the coiled tubing string remains positioned within the casing, wherein the first diverting material hydraulically isolates the re-fractured first location from the multizone horizontal wellbore uphole of the first location;

hydraulically isolating a second location from a portion of the multizone horizontal wellbore uphole of the second location, the second location having been previously hydraulically fractured at least once, wherein hydraulically isolating the second location comprises creating a seal with the packing element connected to the coiled tubing string to seal the annulus between the coiled tubing string and the casing of the multizone horizontal wellbore uphole of the second location;

hydraulically re-fracturing the second location by pumping fluid down the coiled tubing string while the packing element seals the annulus; and providing a second diverting material proximate to the second location after the second location has been re-fractured while the coiled tubing string remains positioned within the casing, wherein the second diverting material hydraulically isolates the re-fractured second location from a portion of the multizone horizontal wellbore uphole of the second location.

2. The method of claim 1, wherein the first location is a fracture cluster farthest downhole of the multizone horizontal wellbore.

3. The method of claim 1, further comprising cleaning out at least a portion of the multizone horizontal wellbore prior to hydraulically isolating the first location.

4. The method of claim 3, further comprising cleaning out at least a portion of the multizone horizontal wellbore after re-fracturing the first and second locations to remove the first and second diverting materials from the multizone horizontal wellbore.

5. The method of claim 4, further comprising producing hydrocarbons from the re-fractured first and second locations of the multizone horizontal wellbore.

6. The method of claim 1, wherein the first and second diverting material comprises one or more of a thermoset plastic, a thermoset polymer, a sand plug, disintegrating frac balls, a gel, a cross-linked gel, frac balls, dissolving material, fiber laden diversion fluid, particulates, or a bridge of degradable particles.

7. The method of claim 1, further comprising determining whether to hydraulically re-fracture the first location prior to hydraulically re-fracturing the first location.

8. The method of claim 7, further comprising determining whether to hydraulically re-fracture the second location prior to hydraulically re-fracturing the second location.

9. The method of claim 8, wherein determining whether to hydraulically re-fracture the first location and the second location further comprises logging the first and second locations with a logging tool.

10. The method of claim 1, wherein there is at least one fracture cluster positioned between the first location and the second location and hydraulically isolating the second location further comprises providing a third diverting material between the first and second locations while the coiled tubing string remains positioned within the casing and creating a seal with the packing element connected to the coiled tubing string to seal the annulus between the coiled tubing string and the casing of the multizone horizontal wellbore uphole from the second location, wherein the third diverting material is provided prior to creating the seal uphole from the second location.

11. The method of claim 10, wherein providing the third diverting material further comprises pumping the third diverting material down the coiled tubing string.

12. The method of claim 1, wherein providing the first diverting material proximate to the first location after the first location has been hydraulically re-fractured further comprises pumping the first diverting material down the coiled tubing string and wherein providing the second diverting material proximate to the second location after the second location has been re-fractured further comprises pumping the second diverting material down the coiled tubing string.

13. A method for selectively re-fracturing one or more previously fractured locations within a horizontal wellbore, the method comprising:

positioning a tubing string within casing of a horizontal wellbore;

positioning a packing element uphole of a first previously fractured location, the packing element being connected to the tubing string;

actuating the packing element to seal an annulus between the tubing string and the casing uphole of the first previously fractured location;

pumping fluid down the tubing string to re-fracture the first previously fractured location while the packing element seals the annulus;

providing a first diverting material proximate the re-fractured first previously fractured location while the tubing string remains within the casing, the first diverting material hydraulically isolating the first previously fractured location after it has been re-fractured;

unsetting the packing element;

positioning the packing element uphole of a second previously fractured location;

actuating the packing element to seal the annulus between the tubing string and the casing uphole of the second previously fractured location;

pumping fluid down the tubing string to re-fracture the second previously fractured location while the packing element seals the annulus; and providing a second diverting material proximate the re-fractured second previously fractured location while the tubing string remains within the casing, the second diverting material hydraulically isolating the second previously fractured location after it has been re-fractured.

14. The method of claim 13, further comprising positioning a testing device proximate to the first previously fractured location and determining that the first previously fractured location should be re-fractured prior to re-fracturing the first previously fractured location and positioning the testing device proximate to the second previously fractured location and determining that the second previously fractured location should be re-fractured prior to re-fracturing the second previously fractured location.

15. The method of claim 13, further comprising removing the first and second diverting materials and producing hydrocarbons from the re-fractured first and second previously fractured locations.

16. The method of claim 13, further comprising determining a third previously fractured location should not be re-fractured prior to positioning the packing element uphole of the second previously fractured location, wherein the third previously fractured location is positioned between the first previously fractured location and the second previously fractured location.

17. The method of claim 16, further comprising providing a third diverting material proximate the third previously fractured location prior to positioning the packing element uphole of the second previously fractured location.

18. The method of claim 17, wherein providing the third diverting material proximate the third previously fractured location further comprises pumping the third diverting material down the tubing string.

19. The method of claim 13, wherein providing the first diverting material proximate the re-fractured first previously fractured location further comprising pumping the first diverting material down the tubing string and wherein providing the second diverting material proximate the re-fractured second previously fractured location further comprises pumping the second diverting material down the tubing string.

* * * * *